United States Patent [19]

Thorpe

[11] 4,449,378

[45] May 22, 1984

[54] INSULATED CHEST

[75] Inventor: Kenneth J. Thorpe, Brooklyn, N.Y.

[73] Assignee: Mitchell B. Shenkman, Brooklyn, N.Y.

[21] Appl. No.: 341,135

[22] Filed: Jan. 20, 1982

[51] Int. Cl.[3] ..... F25D 3/08

[52] U.S. Cl. ..... 62/371; 62/457; 62/259.3

[58] Field of Search ..... 62/371, 372, 457, 458, 62/459, 463, 464, 465, 529, 530, 259.3; 215/13 R

[56] References Cited

U.S. PATENT DOCUMENTS

| | | | |
|---|---|---|---|
| 2,558,181 | 6/1951 | Kassel | 62/457 X |
| 4,322,954 | 4/1982 | Sheehan et al. | 62/457 X |
| 4,351,165 | 9/1982 | Gottsegen et al. | 62/371 |
| 4,375,828 | 3/1983 | Biddison | 62/371 X |

FOREIGN PATENT DOCUMENTS

| | | | |
|---|---|---|---|
| 3013180 | 8/1981 | Fed. Rep. of Germany | 62/457 |

*Primary Examiner*—Lloyd L. King

[57] ABSTRACT

An insulated chest for the storage and transportation of hot and cold foods to be carried as a backpack is disclosed. The chest has a hollow box-like body having four side walls, a bottom wall and top wall. There is a first opening in one of the side walls and a door adapted to be opened and closed is attached to the body so that it seals the opening when in a closed position. In the interior of the chest a removable divider is detachably connected to the side walls below the first opening. The chest can also have a second divider sealingly connected to the side walls in the interior of the chest, defining a liquid-holding chamber. A spigot mounted on a side wall extends through the side wall into the liquid-holding chamber. One of the walls has a second opening to the liquid-holding chamber, through which the chamber can be filled with liquid, and there are means for sealing the second opening.

7 Claims, 3 Drawing Figures

INSULATED CHEST

BACKGROUND OF THE INVENTION

The present invention relates to an insulated chest, for the storage and transportation of foods, which is carried as a backpack. The chest can also have a compartment for the storage and dispensing of liquids.

At the present time when people go on outings, such as picnics, hikes or the like, and they wish to keep the foods or liquids they bring, hot or cold, prior to their consumption, they utilize a portable insulated chest for this purpose. However, the problem with the portable insulated chests now in use is that they are not really very portable. They are usually meant to be transported in an automobile trunk to the site where the outing will occur as set forth in U.S. Pat. No. 3,395,550. Thus, the insulated chest cannot be taken on hikes. Even when the chest has handles, so that it can be carried, it is still not convenient to carry for long distances and requires both arms.

Furthermore, when a person is going on an outing and taking both foods and liquids, it is necessary for each to be taken in separate containers, if walking to reach the site of the outing is necessary. While insulated chests which have compartments both for food and liquid exist, as in U.S. Pat. No. 3,395,550, they are only meant to be transported by a vehicle to the site of the outing. In addition, those containers which are portable, such as those shown in U.S. Pat. Nos. 2,350,184 and 2,684,787 are only meant for the storage and transportation of liquids.

SUMMARY OF THE INVENTION

The disadvantages set forth above are eliminated by the present invention which is an insulated chest meant to be carried as a backpack. Also, it can have a compartment for the carrying of liquids, eliminating the need for taking separate chests for liquid and food when going on outings. In addition, as the chest can be made from a thermoplastic material, it can be made inexpensively but still be durable.

The invention comprises a chest, made of a heat insulating material, such as a thermoplastic material, having four side walls, a top wall and a bottom wall. One of the side walls has a first opening through which the items to be carried can be placed in the chest. A door adapted to open and close and adapted to seal the first opening is attached to the chest. In the interior of the chest, a first divider is detachably connected to the four side walls below the first opening and spaced above the bottom wall. Thus, ice or other items used to keep foods cold can be placed below the divider and the items to be kept cold, such as food or canned liquids, can be placed either above or below the divider. Straps which permit the chest to be carried as a backpack are attached to the exterior of the chest.

As another feature the chest can have a separate compartment for the sotrage and dispensing of liquids. A second divider is sealingly connected in the interior of the chest to each of the side walls above the first opening. A recessed spigot for dispensing the liquid extends into the space above the second divider. The chest has a third opening which permits the space defined by the second divider, the side walls and the top wall to be filled with a liquid. Also, the third opening has means for sealing it closed.

Additional features such as straps for carrying umbrellas and blankets and pockets for carrying other articles can be attached to the exterior of the chest.

BRIEF DESCRIPTION OF THE DRAWINGS

Further features and advantages of the invention become clear from the following description and drawings.

PREFERRED EMBODIMENT

Figure 1:
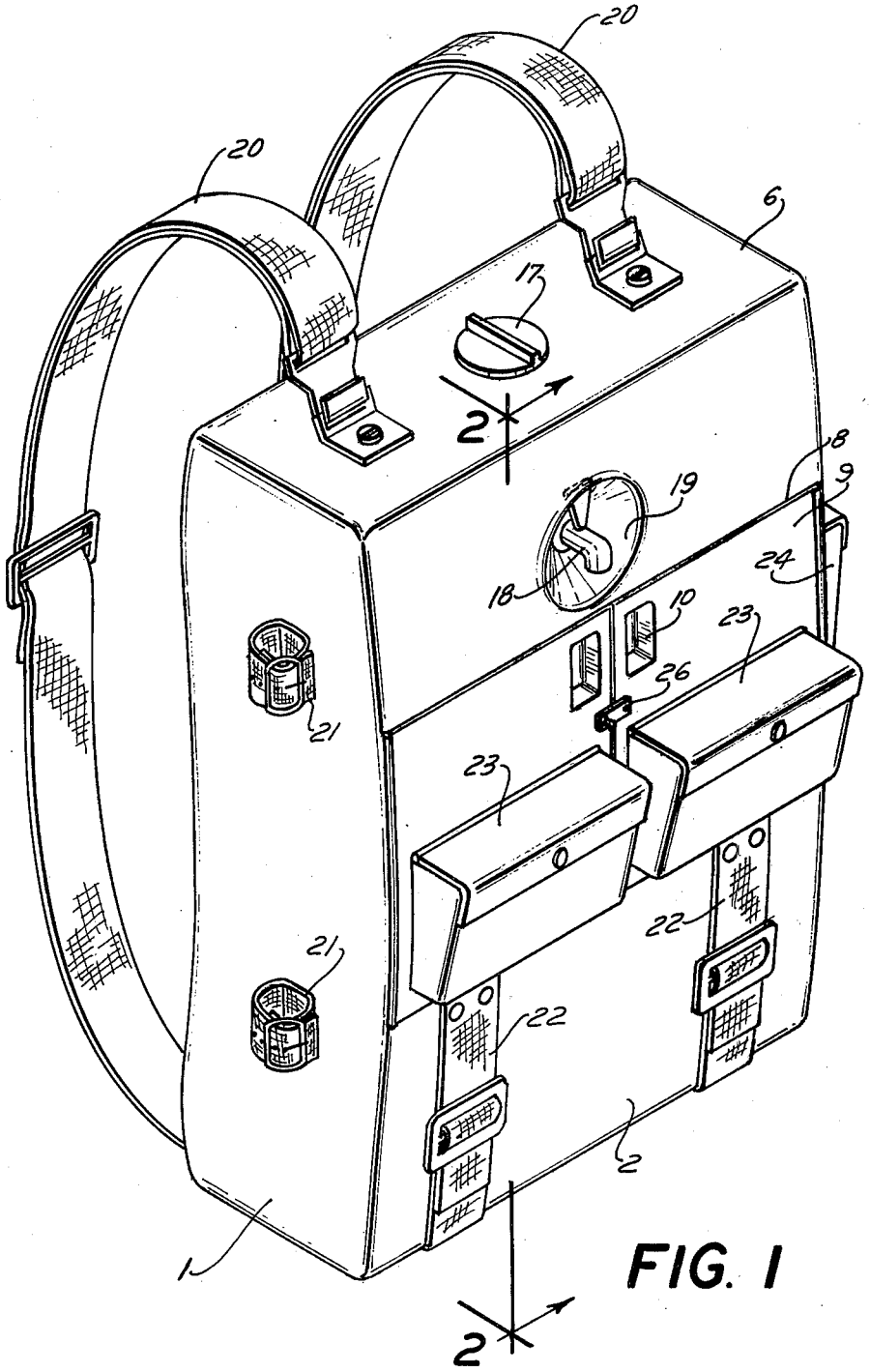
FIG. 1 is a perspective view showing the chest.
Figure 2:
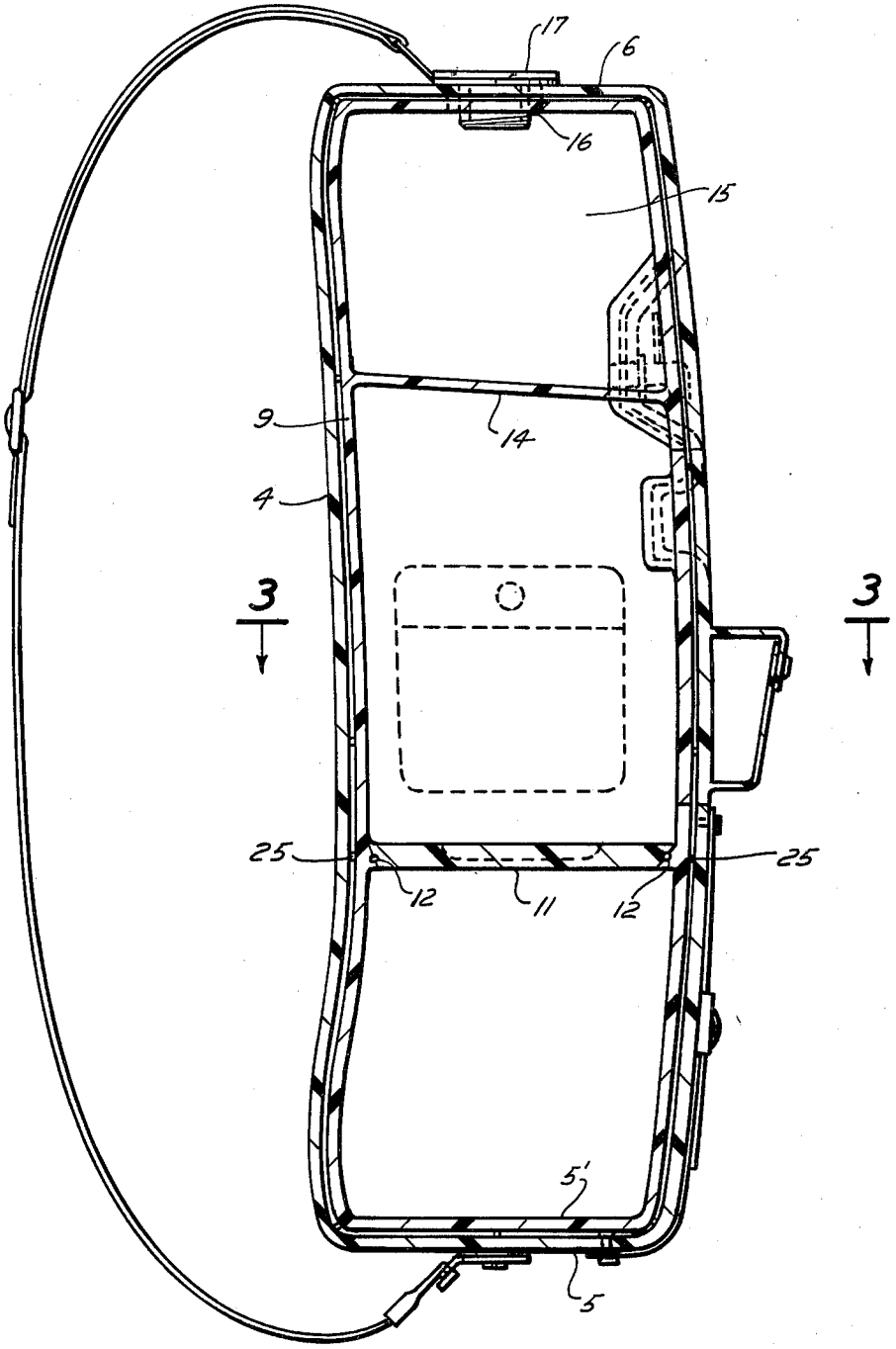
FIG. 2 is a section along plane 2—2 in FIG. 1.
Figure 3:
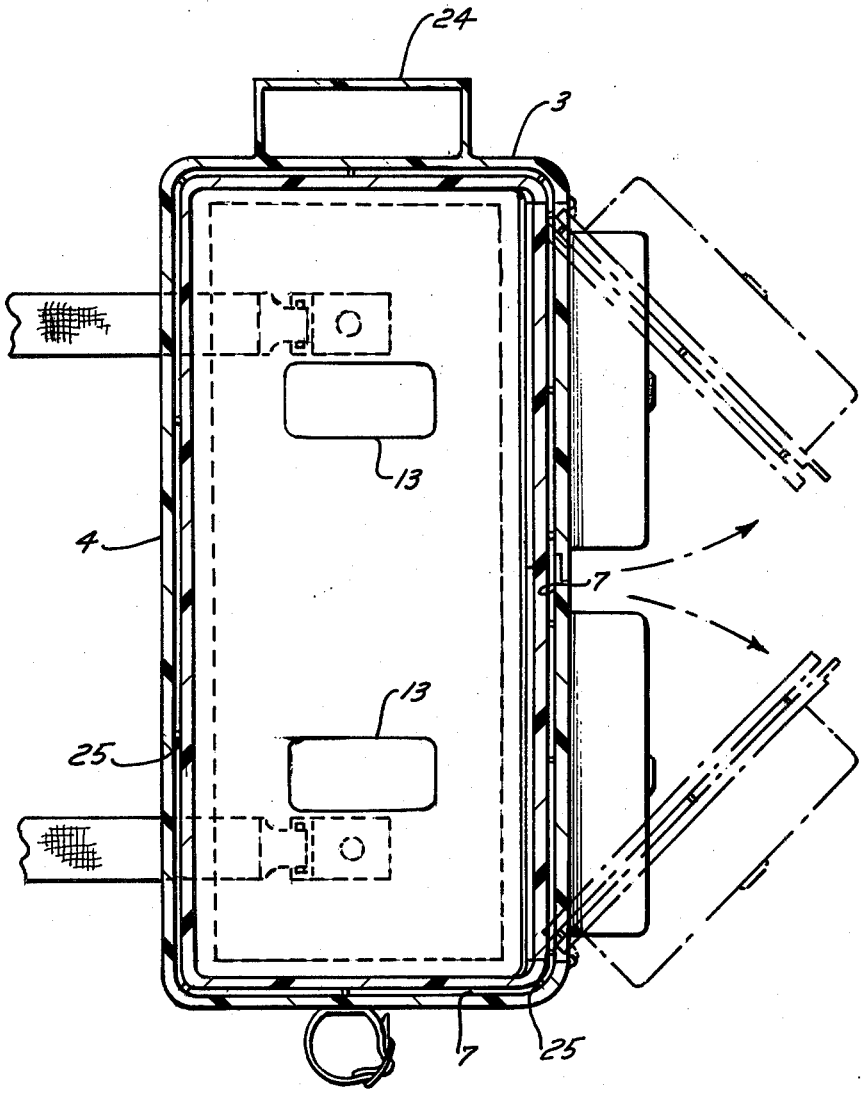
FIG. 3 is a section along plane 3—3 in FIG. 2.

As shown in the drawings, the chest, which is preferably molded from a thermoplastic material, has four side walls 1, 2, 3, and 4, a bottom wall 5, and a top wall 6. The side wall 4 which rests against a person's back when the chest is being carried is contoured to facilitate carrying the chest. Each wall comprises an inner layer of material (designated by the prime of the number) and an outer layer of material (which may be identical to that of the inner layer) separated by an air space 7. The two layers of material in each wall are separated by ribs 25 as shown in FIG. 2.

In the side wall 2 there is a first opening 8 which extends the width of the side wall 2. A pair of doors 9 adapted to be opened and closed and preferably made of the same material as the chest are attached by conventional hinges or other means to the exterior of the chest and seal the first opening 8 when in a closed position. Each door is also made of an inner layer of material and outer layer separated by an air space 7 with the ribs 25 keeping the two layers apart. Each of the doors 9 has a recess 10 to facilitate their opening. Also, attached to the doors is a latch 26 which prevents the doors 9 from opening when they are in the closed position.

In the interior of the chest, below the first opening 8 is a first divider 11. The first divider 11 is parallel to the interior layer of the bottom 5 and is detachably connected to each of the side walls 1', 2', 3', and 4'. The first divider is held in position by protrusions 12 on each of the side walls 1', 2', 3', and 4'. The protrusions 12 are adapted to matingly fit into recesses in the divider 11. The first divider 11 also has two recesses 13 on its upper side into which a person can put his or her fingers to facilitate removing the first divider 11.

Above the first opening 8 in the interior of the chest a second divider 14 is sealingly connected to each of the side walls 1', 2', 3', and 4', creating a storage area 15 in which liquid can be stored. A second opening 16 through which the storage area 15 can be filled with liquid is located in the top wall 6. The second opening 16 is sealingly closed by a filler cap 17, which is detachably connected to the second opening 16.

A spigot 18 extends through side wall 2 into the storage area 15 to permit the dispensing of any liquid contained therein. The spigot 18 is located in a recess 19 in side wall 2 so that the spigot 18 does not protrude beyond the side wall 2. The second divider 14 is disposed at an angle so that any liquid in storage area 15 will flow toward spigot 18.

Attached to the top wall 6 and to the bottom wall 5 are straps 20 to permit the chest to be carried as a backpack with side wall 4 being the one next to the back of the person carrying the chest.

Attached to side wall 1 are two straps 21 whereby an umbrella or similar item can be carried on the chest. Also, attached to side wall 2 below the first opening 8 and to the bottom wall 5 are straps 22 for the carrying of a blanket or similar sized object. Furthermore, attached to each door 9 and to side wall 3 are, respectively, pouches 23 and 24 in which other items for the outing can be carried.

Although the invention is illustrated and described with reference to a plurality of embodiments thereof, it is to be expressly understood that it is in no way limited to the disclosure of such preferred embodiments, but is capable of numerous modifications within the scope of the appended claims.

I claim:

1. An insulated chest, for the storage and transportation of hot and cold foods to be carried as a backpack comprising, (a) a hollow box-like body portion having a top, bottom and four side walls made of heat insulating material, with one of the side walls having a first opening, (b) a door made of heat insulating material adapted to be mounted on said body portion for closing said first opening, (c) a removable first divider disposed in the interior of the body below the first opening in the side wall, which first divider is detachably connected to the side walls and spaced above the bottom wall, dividing the interior of the body portion into an upper and lower area, (d) means attached to the exterior of the body portion for carrying the chest on a person's back, (e) a second divider disposed in the interior of the body above the first opening which divider is sealingly attached to each of the side walls so as to define an upper chamber adapted to hold liquid, (f) a spigot mounted to a side wall and extending through the side wall into the liquid-holding chamber, (g) said top of the body having a second opening into the liquid-holding chamber through which the liquid-holding chamber can be filled with a liquid, and (h) means for sealing the second opening when liquid is in the liquid-holding chamber.

2. An insulated chest as claimed in claim 1, wherein the second divider is sealingly attached to the side walls at an angle so that any liquid stored in the liquid-holding chamber will flow towards the spigot.

3. An insulated chest as claimed in claim 1, wherein the side wall through which the spigot extends has a recessed portion and the spigot is mounted in the recess.

4. An insulated chest as claimed in claim 1, wherein the means for carrying the chest on a person's back are two straps which are attached to the exterior of the body.

5. An insulated chest as claimed in claim 1, wherein the second opening is located in the top wall.

6. An insulated chest as claimed in claim 1, wherein at least one of the walls has an inner layer of material and an outer layer of material which are separated from each other by an air space.

7. An insulated chest as in claim 1, wherein at least one of the side walls is contoured so that the chest can be comfortably carried.

* * * * *